US008256119B2

(12) United States Patent
Bolzoni

(10) Patent No.: US 8,256,119 B2
(45) Date of Patent: Sep. 4, 2012

(54) METHOD AND PLANT FOR MANUFACTURING FORKS FOR LIFT TRUCKS

(75) Inventor: Emilio Bolzoni, Piacenza PC (IT)

(73) Assignee: Bolzoni S.p.A., Casoni di Podenzano PC (IT)

( * ) Notice: Subject to any disclaimer, the term of this patent is extended or adjusted under 35 U.S.C. 154(b) by 1184 days.

(21) Appl. No.: 12/078,918

(22) Filed: Apr. 8, 2008

(65) Prior Publication Data

US 2008/0256772 A1 Oct. 23, 2008

(30) Foreign Application Priority Data

Apr. 17, 2007 (IT) ..... MI2007A0775

(51) Int. Cl.
*B21D 53/88* (2006.01)

(52) U.S. Cl. ..... 29/897.2; 29/525.14; 29/428; 29/429; 72/352; 72/269; 72/380

(58) Field of Classification Search ..... 29/897.2, 29/429, 525.14, 428; 72/352, 369, 380
See application file for complete search history.

(56) References Cited

U.S. PATENT DOCUMENTS

2002/0170177 A1* 11/2002 Koyama et al. ..... 29/897.2
2004/0112522 A1* 6/2004 Ward et al. ..... 156/290
2008/0246308 A1* 10/2008 Uchida et al. ..... 296/187.03

* cited by examiner

*Primary Examiner* — Derris Banks
*Assistant Examiner* — Azm Parvez
(74) *Attorney, Agent, or Firm* — Jacobson Holman PLLC

(57) ABSTRACT

A method of manufacturing forks for lift trucks comprises the steps of:

providing a straight metal bar designed to make the fork, heating the bar at a segment thereof where the fork knee is to be formed, bending the bar at the heated segment in order to form the knee by carrying out bending in a closed-die press provided with containment walls that, when bending has been completed, enclose the knee so as to define the surface contours of the latter.

21 Claims, 6 Drawing Sheets

METHOD AND PLANT FOR MANUFACTURING FORKS FOR LIFT TRUCKS

BACKGROUND OF THE INVENTION

1. Field of the Invention

The present invention relates to an innovative method of manufacturing forks for lift trucks and also to a plant for putting said method into practice.

2. State of the Prior Art

Manufacture of forks for lift trucks starting from segments of a steel bar of rectangular section is known in the art. At the beginning, the bar is tapered at an end thereof, then bending of the knee is carried out to obtain the traditional L-shaped configuration of the item; the fork is then heat-treated (with a hardening and tempering operation), then the fastening hooks are welded and finally the item is submitted to sandblasting, checking and painting operations. The bending process of the knee and heat treatment commonly used however do not allow forks to be obtained which correspond in size to the specifications. Therefore a process for straightening the fork after the heat treatment is often required.

In addition, after bending, grinding of the knee intrados and side faces is made necessary in order to eliminate burrs, surface unevennesses and defectivenesses, such as laps and more or less marked waving in the bent region of the fork, which, as known, is the most critical region in terms of fatigue strength.

Straightening and grinding make the fork manufacturing process much longer and particularly expensive, also taking into account that both operations can be hardly automated. Another problem connected with known processes resides in that straightening carried out under cold conditions induces residual tensile stresses that, added to the operating stresses, reduce the useful load of the fork. Straightening can also cause appearance of microcracks that can be hardly detected using traditional non destructive tests; the presence of these cracks drastically decreases reliability of the product as they constitute dangerous initiation points of fatigue failure during use.

In addition, the grinding operation can reduce the local resilient properties of the fork, as it involves work hardening in the ground region and locally modifies the material fibering obtained by hot plastic deformation.

It is a general aim of the present invention to obviate the above mentioned drawbacks by providing a method and a plant enabling manufacture of the fork in a quick, cheap and highly automated manner.

It is a further aim of the invention to provided a method and a plant enabling manufacture of a fork having satisfactory mechanical features (ultimate tensile stress, fatigue strength) and high reliability.

SUMMARY OF THE INVENTION

In view of the above aims, a method of manufacturing forks for lift trucks has been devised, in accordance with the invention, which comprises the steps of:

providing a straight metal bar designed to make the fork, heating the bar at a segment thereof where the fork knee is to be formed, bending the bar at the heated segment in order to form the knee by carrying out bending in a closed-die press provided with containment walls that, when bending has been completed, enclose the knee so as to define the surface contours of the latter.

Still in accordance with the invention, accomplishment of a plant for manufacturing forks for lift trucks has been conceived, which comprises means for sequentially feeding straight metal bars designed to form the forks, means for heat-bending the fed bars so as to form forks provided with a knee, heating means downstream of the bending means suitable for bringing the forks to an appropriate temperature for subsequent hardening, and hardening means downstream of the heating means to harden the forks heated by said heating means, characterized in that the bending means comprises a closed-die press provided with containment walls that, when bending has been completed, are adapted to enclose the fork knee so as to define the surface contours of the latter.

BRIEF DESCRIPTION OF THE DRAWINGS

For better explaining the innovative principles of the present invention and the advantages it offers over the known art, a possible embodiment applying these principles will be described hereinafter, by way of example, with the aid of the accompanying drawings. In the drawings.

DETAILED DESCRIPTION OF THE INVENTION

Figure 1:
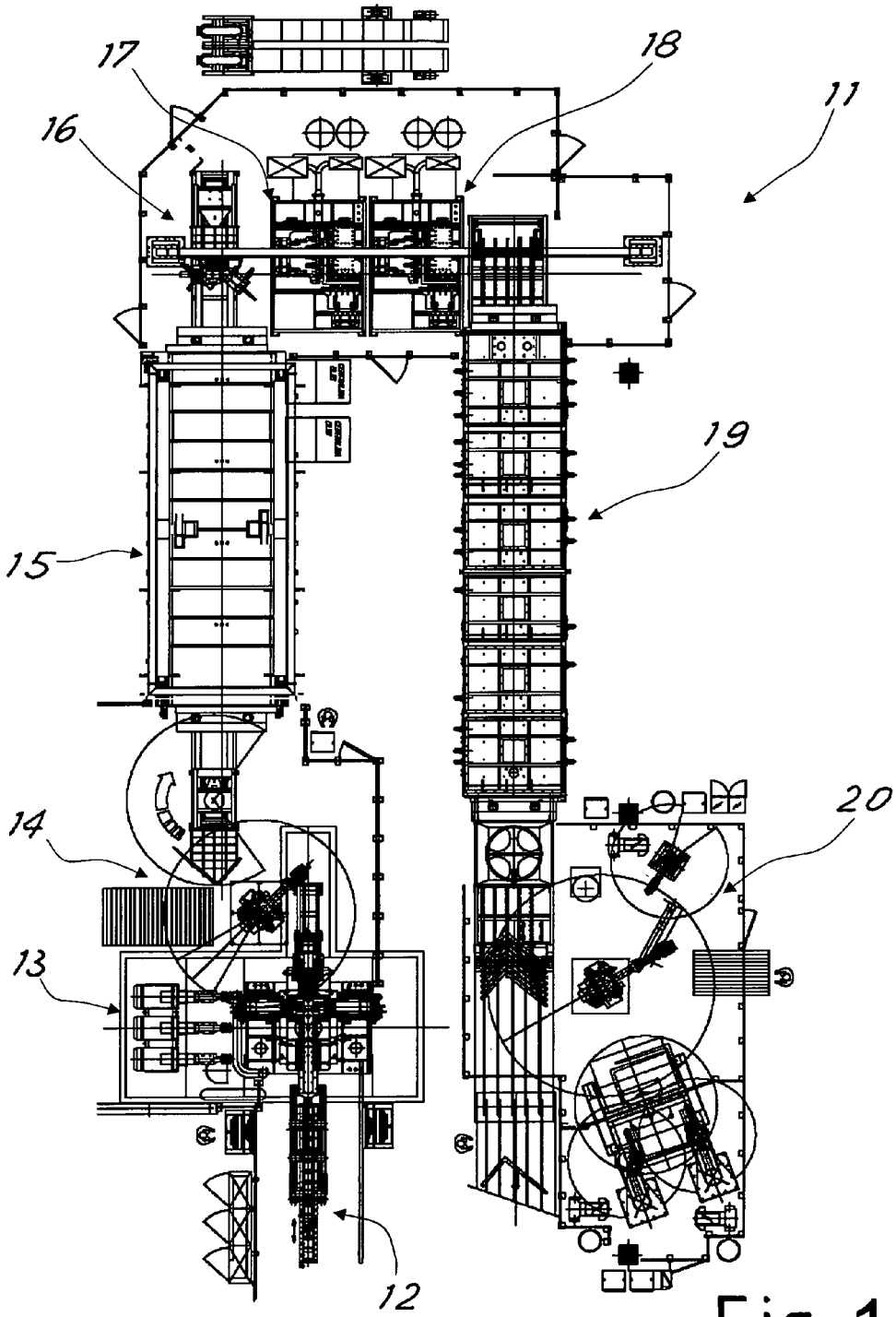
FIG. 1 is an overall view of the production plant for forks in accordance with the invention.

With reference to the figures, FIG. 1 shows part of the production plant 11 for forks of lift trucks comprising a feeding line 12 to sequentially supply steel bars to a bending station 13 where the fork knee is to be formed. Upstream of the feeding line there are known means for mechanically cutting the bar, means for tapering of the tip by a jigsaw and means for trimming the tip through cuts with use of a plasma or oxyacetylene torch. These cutting, tapering and trimming means are accomplished following the known art and are not represented in the figure.

Present along the feeding line 12 is means for induction heating of the bars in the region where the fork knee is to be made. Preferably, induction heating takes place in three sequential steps so as to ensure temperature homogeneity at the bar segment to be bent in order to form the knee.

Line 12 is provided with actuating means to cause automatic sliding of the bars until the latter reach the starting position of the bending cycle within press 13. As described in the following, press 13 is a multiple-action press, provided with a closed cavity having surfaces internally reproducing the surfaces of the fork knee.

After bending, the bent fork is removed from press 13 through transfer means 14 and is fed to a furnace 15 adapted to bring the fork to the austenitizing temperature for subsequent hardening.

The transfer means 14 can comprise robotized arms and grasping pliers adapted to lay the bent fork on a conveyor moving through the continuous austenitizing furnace 15.

On coming out of furnace 15, the fork is picked up by second automated transfer means 16 and is introduced into a hardening apparatus. Shown in the figure are two similar apparatuses 17, 18 disposed in side by side relationship, but it is understood that only one apparatus could be present. The hardening apparatus 17, as better explained in the following, enables hardening under pressure to be carried out, due to the presence of a series of positioning means that during hardening imposes constraints on positioning of the fork along the longitudinal extension thereof. As will be seen, this particular expedient allows heat deformations to be advantageously contained.

Downstream of the hardening apparatus 17, 18, the plant comprises a continuous furnace 19 for tempering of the fork. Furnace 19 is passed through by a conveyor on which the forks are laid using the transfer means 16.

Advantageously, during both the hardening and tempering operations, heating takes place gradually so as to reduce the possibility of deformation of the fork due to release of pre-existing stresses.

Downstream of the tempering furnace 19, the forks are cooled by means of blown air and are then fed to a robotized welding station 20 for fastening of the supporting hooks. Welding of the hooks is carried out by exploiting the residual heat from tempering, further heating activities of the piece before welding being avoided.

Following welding of the hooks, the fork is submitted to sandblasting, washing, drying and painting in respective stations of the plant that are not shown in the figure and are made in accordance with the known art. However, washing and drying could also be absent from the manufacturing cycle. Alternatively, welding of the supporting hooks could also take place immediately after forming of the knee, the workpiece being then treated with the hooks already welded thereto.

Figure 2:
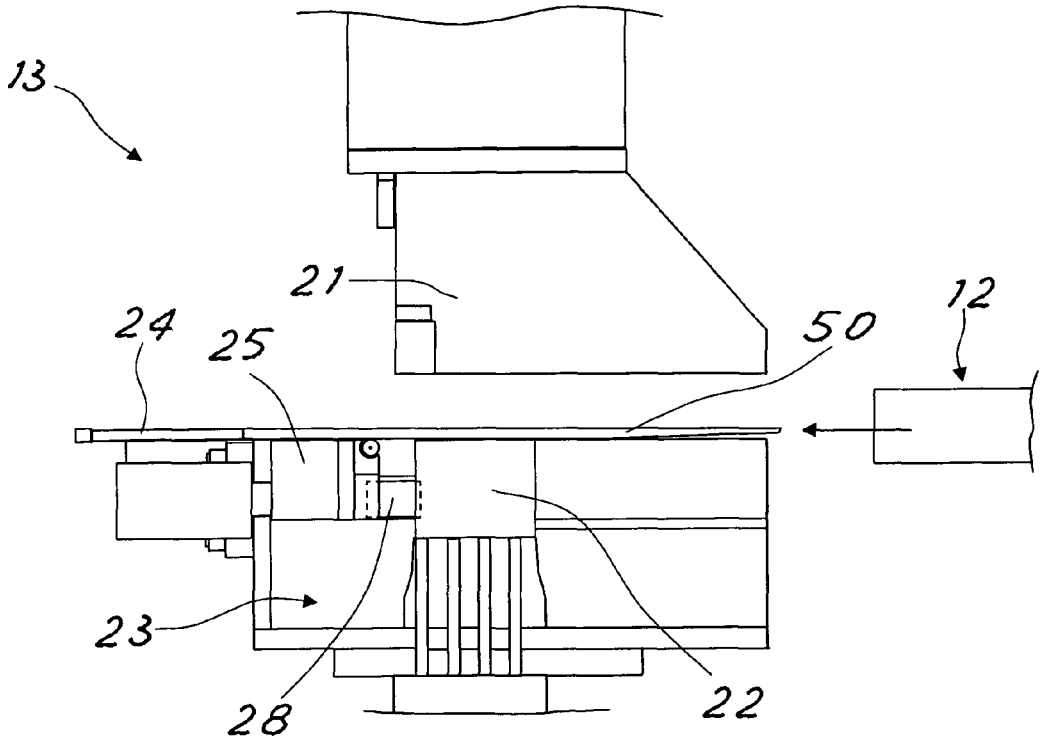
FIGS. 2 to 6 are diagrammatic side views of the press for bending of the knee in different steps of a bending cycle applied to the straight bar.

Diagrammatically shown in FIG. 2 is the multiple-action closed-die press 13, in a first step of feeding the straight bar 50 supplied by line 12. As said, the bar 50 portion designed to be bent is previously heated to be brought to the necessary plasticity level for bending deformation in the press.

Figure 3:
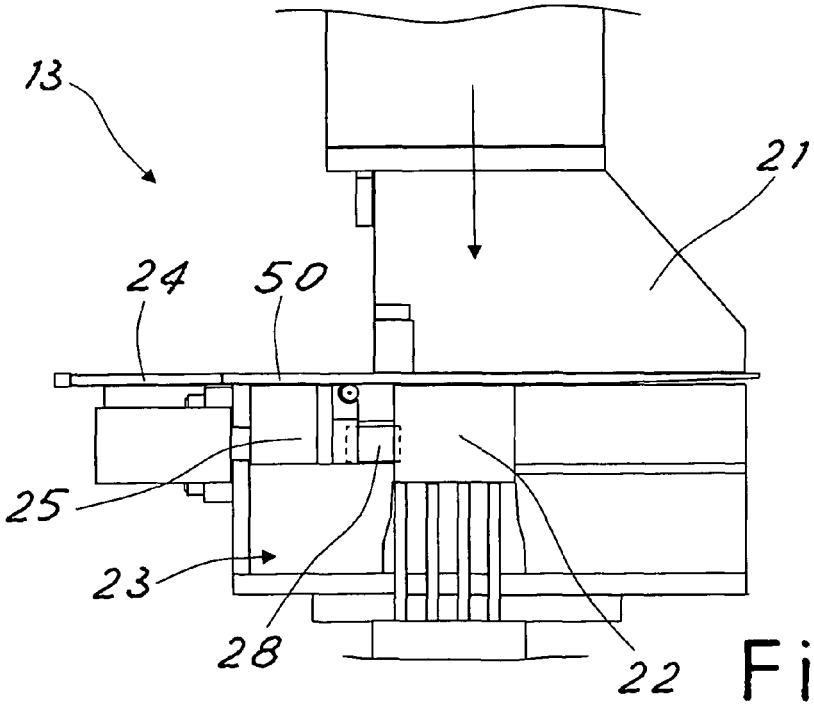

After entry of bar 50 into press 13 (FIG. 2), an upper locking element 21 is vertically moved downwards until the position shown in FIG. 3 for locking of the bar 50 in cooperation with a lower locking element 22. The two elements 21, 22 are mounted in a vertically movable position in a frame 23 of press 13 and are moved by means of known hydraulic actuating cylinders (not shown in the figure).

When the bar is locked as shown in FIG. 3, the horizontal upsetting (or heading) operation is carried out using a pusher 24.

Figure 4:
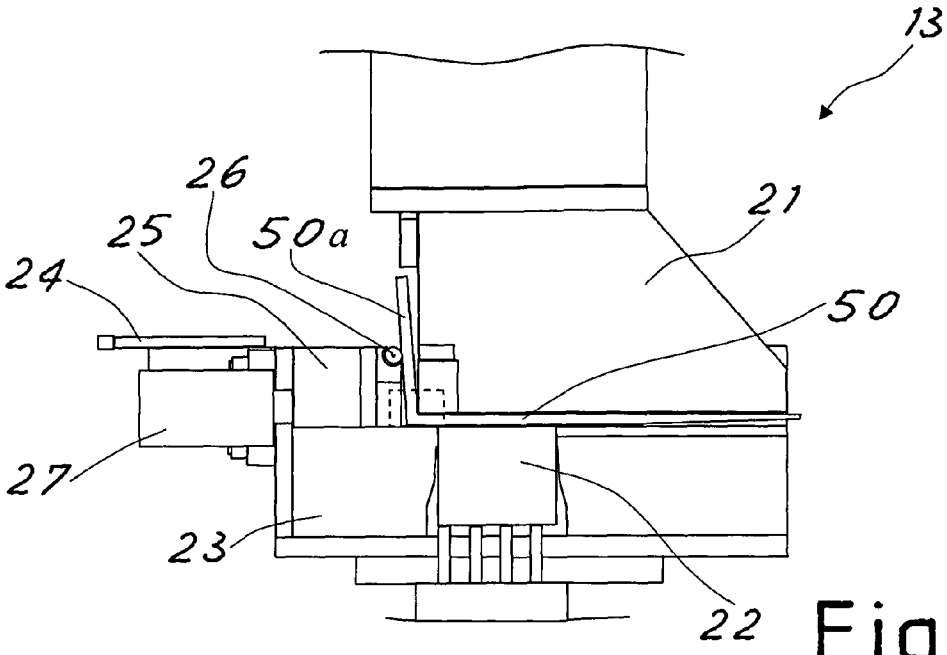

After upsetting, the lower and upper locking elements 21, 22 are lowered until reaching the position shown in FIG. 4 so as to cause a first fork-bending step. The fork segment 50*a* comes into contact with the axial press unit 25, and in particular with a roller 26 of the press unit, imposing a first deformation to the bar, which however does not yet reach a 90° bending.

Figure 5:
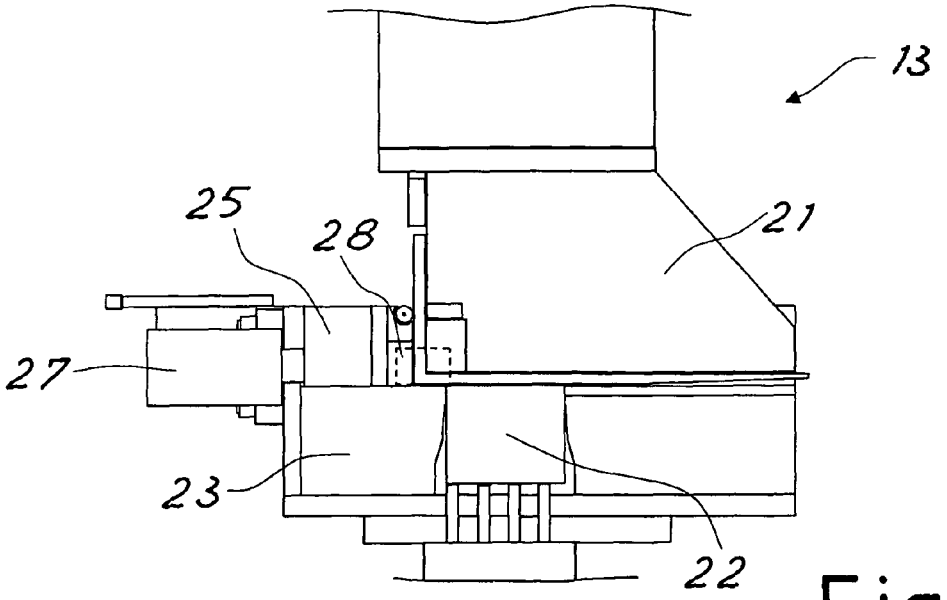

Then the axial unit 25 is moved in a horizontal direction as shown in FIG. 5 through operation of a respective thrust cylinder 27 so as to complete bending until the fork segment 50*a* is brought to a vertical position, being interposed between element 21 and axial unit 25. Simultaneously, the side units 28 are inserted on the opposite lateral sides of fork 50, at the bent knee. A side unit is shown in chain line in FIG. 5 and identified by 28.

Figure 7:
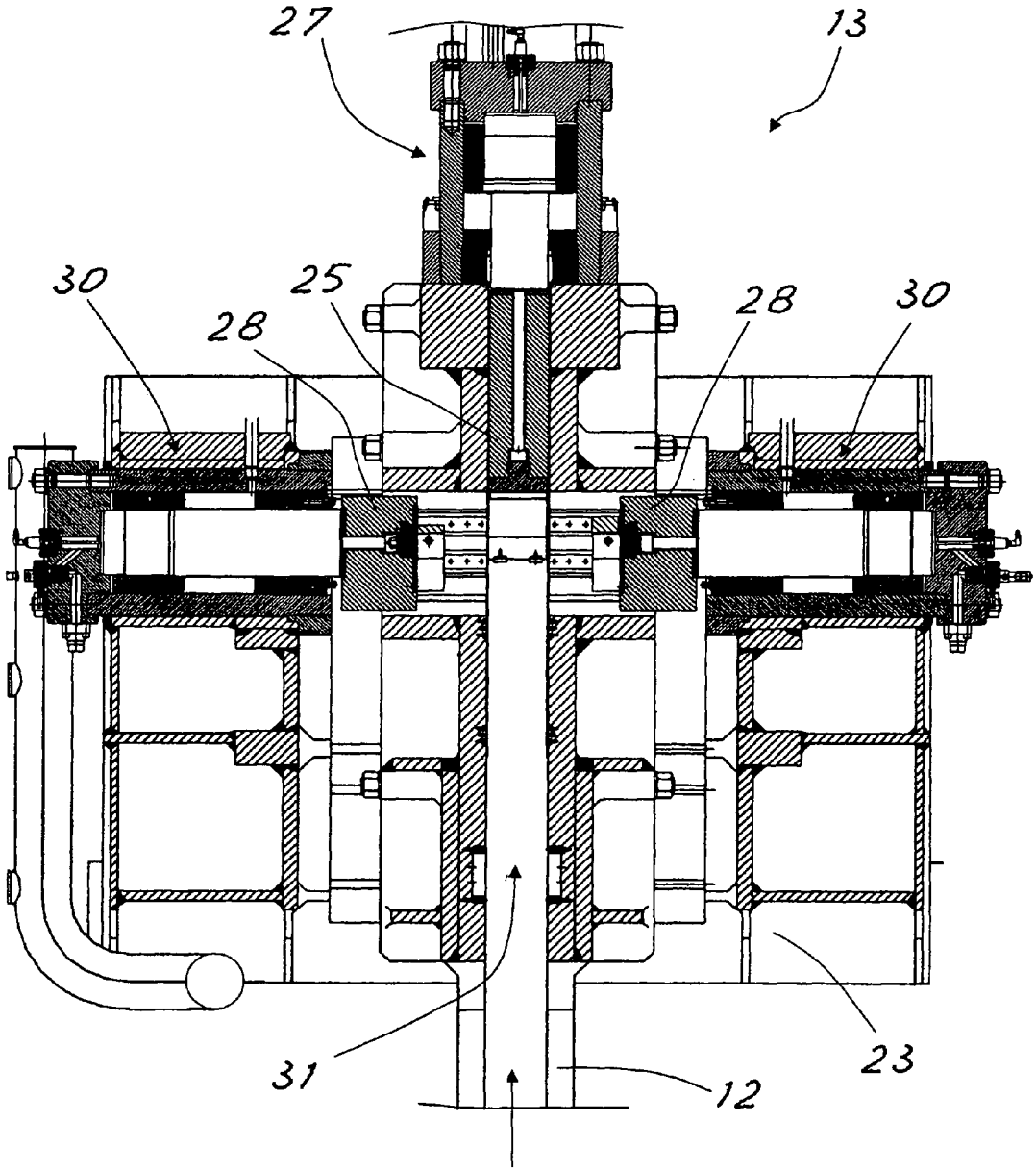
FIG. 7 is a sectional plan view of the bending press or press brake for the knee.

Shown in the sectional plan view of FIG. 7 are the two side units 28 of the press which are adapted to act on opposite sides of the knee during the final forming step so as to form the closed cavity of the die defining the knee surfaces. The side units 28, shown in a non-operating moved away position, are moved by corresponding actuating cylinders 30. Also shown in FIG. 7 is a seat where the bar to be bent is received inside press 13.

Thus press 13 forms a closed cavity at the portion that is submitted to plastic deformation, i.e. the knee, and reproduces all surfaces of same forming a closed-die coining. The critical region of the knee is formed by local coining through hot forging, thus ensuring an optimal repetitiveness of the process and consequently a high reliability of the produced item.

By using a closed-die press in accordance with the invention, the knee perfectly reproduces the shape and surface finish of the press cavity, and grinding operations on the side and intrados faces are no longer required in order to eliminate possible shape faults, laps and surface defectivenesses, as it happened in known processes for manufacturing forks.

The knee-forming cycle in accordance with the invention drastically reduces the average level of the residual stresses and prevents arising of local peaks in the volume distribution of same, thus avoiding a subsequent straightening operation being required in order to remedy unacceptable distortions of the workpiece due to release of the residual stresses, as it happened in known systems for bending the knee.

Figure 6:
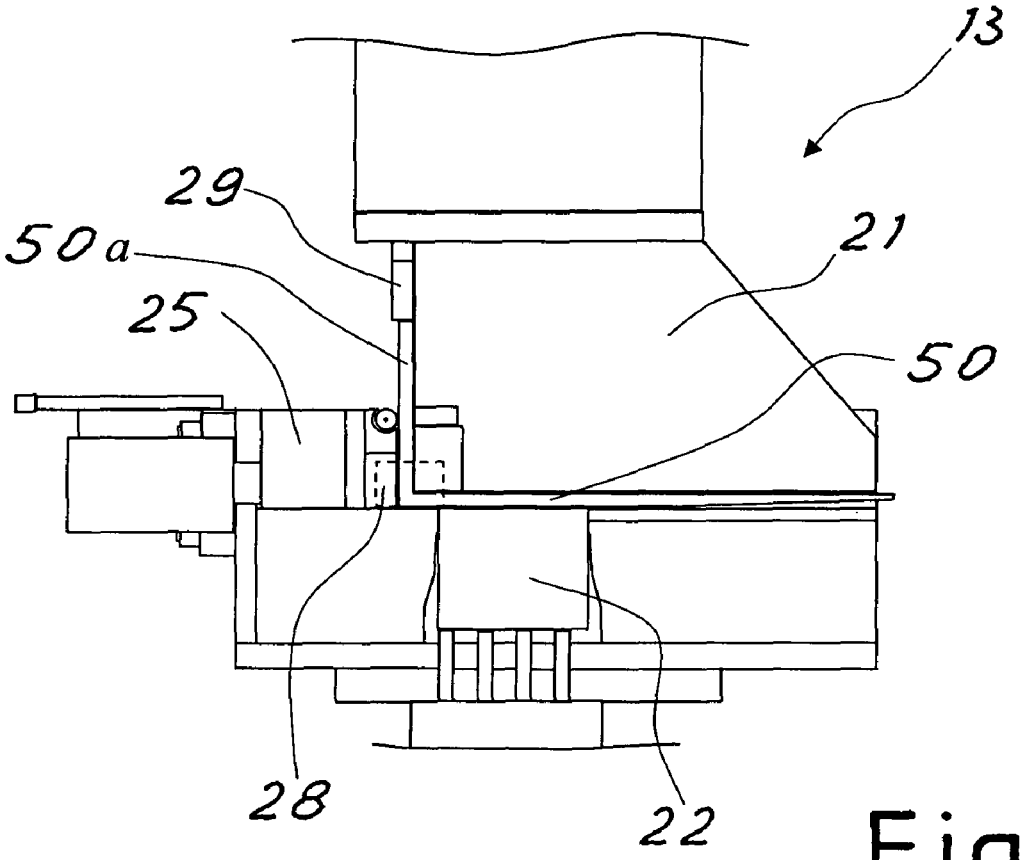

The knee-forming press, if necessary, could form a knee having an adjusted angle that slightly deviates from 90°, so that a right angle is obtained after the heat treatment. Shown in FIG. 6 is the following step of vertically upsetting the fork, when the fork segment 50*a* is pressed by pusher 29 of press 13.

At this point, press 13 is opened, and the workpiece 50 is picked up by a robotized arm so that it is directed to the stations carrying out the hardening and tempering heat treatment.

Figure 8:
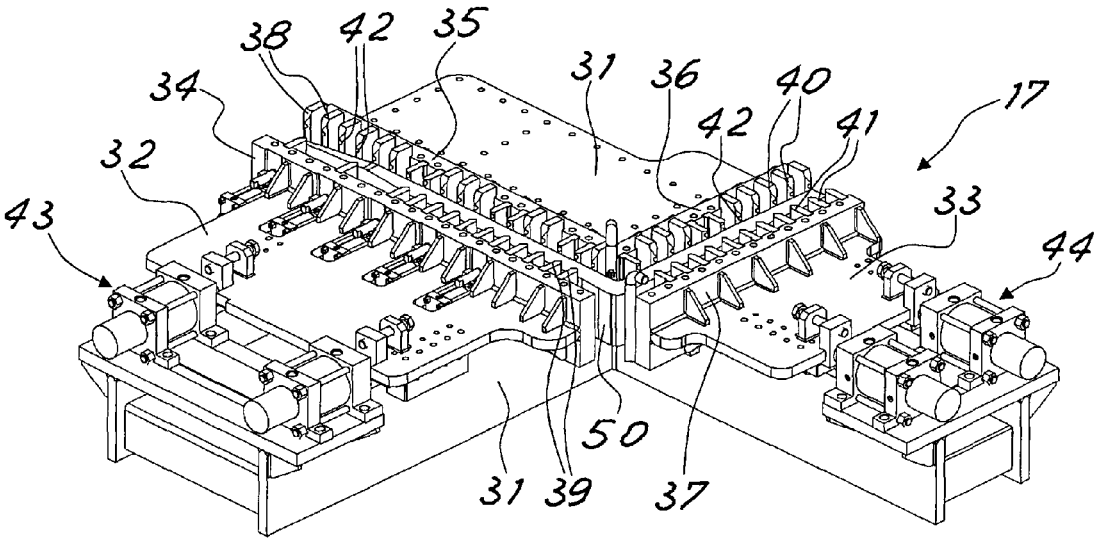
FIG. 8 is a perspective view of the apparatus for hardening of the fork.
Figure 9:
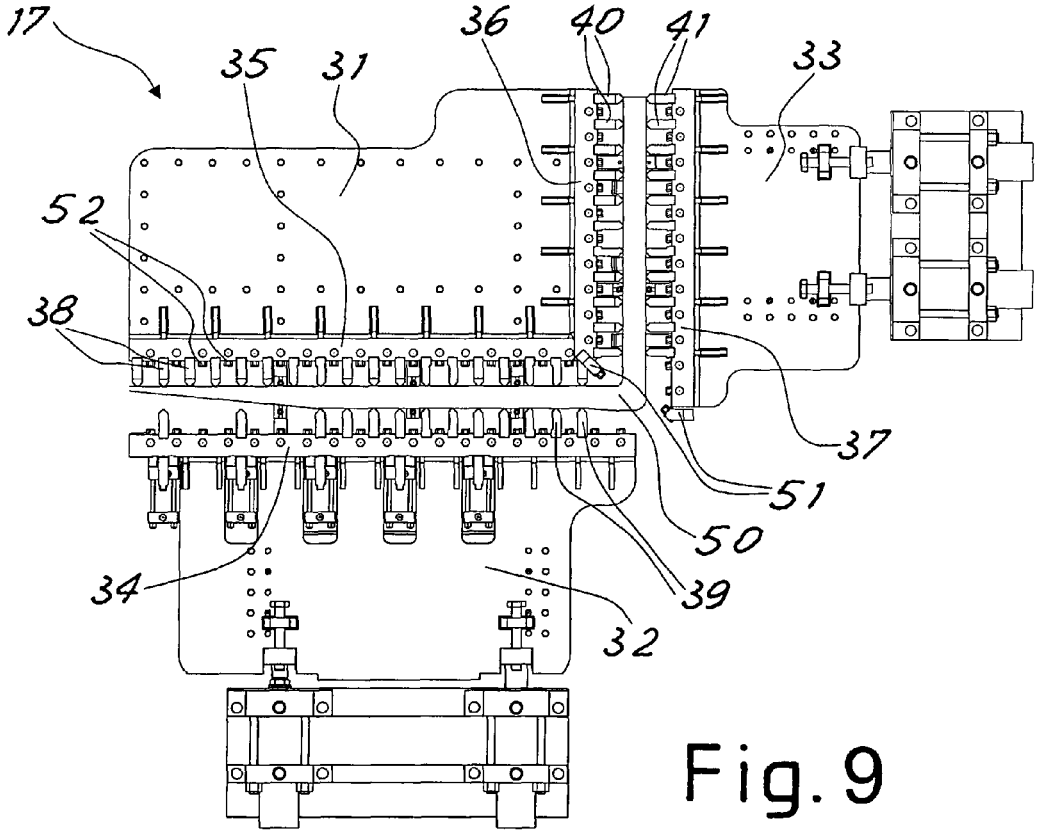
FIG. 9 is a plan view of the apparatus shown in the preceding figure.

Shown in FIGS. 8 and 9 is a hardening apparatus 17 to which the fork is fed at the austenitizing temperature by the automatic bridge transfer means 16.

Apparatus 17 comprises a substantially horizontal fixed frame 31 on which two movable portions 32 and 33 are mounted.

The fixed frame 31 carries two walls 35, 36 orthogonal to each other to which a sequence of positioning elements, 38 and 40 respectively, are fastened, which elements are designed to be disposed in approached relationship with the two fork segments when the fork 50 is received in the apparatus.

The movable portions 32, 33 can slide in directions orthogonal to each other relative to the fixed frame 31 and carry respective vertical walls 34, 37 on which a series of further positioning elements, 39 and 41, are mounted.

The movable portions 32, 33 are moved by known actuating cylinders 43, 44 anchored to the fixed frame 31. The movable wall 34, as arranged, faces the fixed wall 35, while the movable wall 37 faces the fixed wall 36.

For inserting fork 50 into apparatus 17, the two movable walls 34, 37 are moved away from the fixed walls, and are then moved close to each other again so that the positioning elements 39 and 41 are disposed in approached relationship with fork 50, as shown in FIG. 9. The fork, when received in the apparatus, rests on a surface of the fixed frame 31, on a side thereof.

The positioning elements 38-41 are made in the form of knives that are vertically disposed, transversely of the axial extension of the fork.

Knives 38-41 extend longitudinally along fork 50 so as to contain deformations during the hardening step, while leaving a reduced possibility of displacement for normal heat-shrinkage. For instance, knives 38-41 could be some tens of a millimeter away from the fork face which they are disposed close to. The play amount can be advantageously selected as a function of the fork sizes.

Knives 38 fastened to wall 35 correspond in pairs to knives 39 of wall 34, in the same manner as knives 40 correspond to knives 41. In this manner a series of position constraints are obtained along the fork extension, that are advantageously regularly spaced apart from each other. Hardening takes place in a direct manner, the workpiece brought to the austenitizing temperature being impinged on by the hardening medium which is applied by way of nozzles 42 disposed on apparatus 17.

Advantageously, nozzles 42 are disposed on the positioning elements 38-41. As the hardening medium, an aqueous solution consisting of polymers in a 2% to 30%-varying concentration can be employed depending on the steel type used and the fork features to be obtained.

Nozzles are present to a high number (advantageously more than 100), and can be set in small groups, or even individually, by way of suitable control means of apparatus 17.

Flow of the hardening means can be such controlled that uniform and repeatable cooling of the workpiece can be obtained, with a homogeneous metallurgic structure, more tendency to tensioning, and reduction in size deformations as compared with classic hardening.

In addition, due to the possibility of controlling the nozzles divided into groups in an independent manner, the cooling intensity can be locally varied in order to prevent or amend possible shape errors during setting up of the cycle.

Washing nozzles 52 are present between one knife and the subsequent one, said nozzles projecting from walls 34-37 carrying the positioning knives. Also shown in FIG. 9 are attachments 51 for feeding the hardening means to apparatus 17.

Following hardening step at the inside of the apparatus for deformation containment, the workpiece is submitted to tempering in furnace 19, this operation being carried out according to known techniques.

The particular type of hardening carried out in an appropriate apparatus provided with positioning elements and elements for containing deformations allows tensioning of thermal origin and distortions of the workpiece, that usually occur with traditional systems for fork hardening, to be reduced to a minimum.

The plant comprises automatic control means for coordinately commanding operation of the different operating stations and of the transfer means between the different stations. The control means can be accomplished following any known technique.

At this point it is apparent that the purposes of the present invention are achieved. In particular, a method and a plant for manufacturing forks are provided which enables reliable items having a high mechanical strength to be produced in a quick and cheap manner.

Use of the hot-bending technique with immediate coining in a closed die has allowed the overall process to be greatly simplified by providing a fork knee with precisely defined surfaces since the beginning.

In particular, combination of the bending system in a closed die and hardening in an apparatus for deformation containment has allowed achievement of a quick and highly automated fork manufacturing process. In fact, the steps of straightening the workpiece and grinding the knee intrados and sides can be eliminated from the manufacturing process, which steps were necessary in traditional processes.

In addition, the item thus obtained has a good mechanical strength and high reliability, since the two steps (straightening and grinding) eliminated from the process typically introduced a reduction in the useful load, in addition to causing appearance of microcracks of difficult detection.

Obviously, the above description of an embodiment applying the innovative principles of the present invention is given by way of example only and therefore cannot be considered as a limitation of the scope of the patent rights herein claimed.

As an alternative to press hardening in the apparatus for deformation containment, also hardening of the bainitic austempering type in a bath of melt salts has been found advantageous, possibly followed by tempering and quick cooling depending on the material used.

What is claimed is:

1. A method for manufacturing forks for lift trucks comprising the steps of:

providing a straight metal bar designed to make the fork, heating the bar at a segment thereof where the fork knee is to be formed, bending the bar at the heated segment in order to form the knee by carrying out bending in a closed-die press provided with containment walls that, when bending has been completed, enclose the fork knee so as to define surface contours thereof, wherein the fork is heated in a furnace and then transferred to a hardening apparatus where the fork is submitted to hardening, and wherein hardening is carried out by keeping the fork in an apparatus for deformation containment adapted to tightly hold the fork along the longitudinal extension of two arms of the fork during hardening, holding of the fork taking place by a plurality of positioning elements disposed in approached relationship on opposite sides of the fork in a plane containing the fork.

2. The method according to claim 1, characterized in that heating of the fork before hardening takes place in a continuous furnace passed through by a conveyor sequentially carrying the forks.

3. The method according to claim 1, characterized in that hardening takes place by use of an aqueous polymer solution.

4. The method according to claim 1, characterized in that, following hardening, the fork is submitted to tempering.

5. The method according to claim 4, characterized in that, following tempering, supporting hooks are applied to the fork by welding in a robotized welding station, the fork being then submitted to sandblasting and painting.

6. The method according to claim 1, characterized in that said heating before bending of the knee takes place by induction.

7. The method according to claim 1, characterized in that transfer of the bars between the different stations carrying out the different working steps on the fork takes place by automated transfer means.

8. The method according to claim 1, characterized in that hardening is of the bainitic austempering type in a bath of salts.

9. The method according to claim 1, characterized in that immediately after the knee forming, the supporting hooks are welded to the fork.

10. A plant for manufacturing forks for lift trucks, comprising means for sequentially feeding straight metal bars designed to form the forks, means for heat-bending the fed bars so as to form forks provided with a fork knee, heating means downstream of the heat-bending means suitable for bringing the forks to an appropriate temperature for subsequent hardening, and hardening means downstream of the heating means to harden the forks heated by said heating means, wherein the heat-bending means comprises a closed-die press provided with containment walls that, when bending has been completed, are adapted to enclose the fork knee so as to define the surface contours thereof, said closed-die press comprises a pair of locking elements adapted to lock a first segment of the straight bar, said locking elements being movable transversely to of an axial unit of the press to carry out a first fork-bending step, said axial unit being movable transversely to the movement direction of the locking elements to carry out a second fork-bending step, side units being present which are adapted to laterally move close to the fork at the knee so as to form a closed cavity adapted to define the surface contours of the fork knee when bending has been completed.

11. The plant as claimed in claim 10, characterized in that it comprises means for heating the fork portion designed to be bent, said heating means being disposed along a feeding line supplying the straight bars to the closed-die press.

12. The plant according to claim 11, characterized in that said heating means are induction heating means.

13. A plant for manufacturing forks for lift trucks, comprising means for sequentially feeding straight metal bars designed to form the forks, means for heat-bending the fed bars so as to form forks provided with a fork knee, said heat-bending means comprising a closed-die press provided with containment walls that, when bending has been completed, are adapted to enclose the fork knee so as to define the surface contours thereof, heating means downstream of the heat-bending means suitable for bringing the forks to an appropriate temperature for subsequent hardening, and hardening means downstream of the heating means to harden the forks heated by said heating means, wherein the hardening means comprises an apparatus adapted to tightly hold the fork along the longitudinal extension of two arms of the fork thereof during hardening so as to contain the fork deformations during hardening, holding of the fork taking place by a plurality of positioning elements disposed in approached relationship on opposite sides of the fork in a plane containing the fork.

14. The plant according to claim 13, characterized in that said apparatus comprises a plurality of nozzles adapted to apply a hardening medium onto the fork, said nozzles being disposed along the longitudinal extension of the fork when the latter is enclosed in the apparatus.

15. The plant according to claim 14, characterized in that said nozzles designed to apply the hardening medium are disposed on the positioning elements.

16. The plant according to claim 13, characterized in that said positioning elements correspond in pairs on opposite sides of the fork to provide a constraint on a plurality of fork sections along the longitudinal extension thereof.

17. The plant according to claim 13, characterized in that washing nozzles are disposed on the deformation-containing apparatus, being alternated with the positioning elements.

18. The plant according to claim 13, characterized in that the positioning elements are made up of knives disposed transversely of the longitudinal extension of the fork when the latter is inserted in the apparatus.

19. The plant according to claim 10, characterized in that it comprises tempering means downstream of the hardening means.

20. The plant according to claim 19, characterized in that downstream of the tempering means the plant comprises a robotized welding station for applying supporting hooks to the fork through welding, and then means for sandblasting and painting the fork.

21. The plant according to claim 10, characterized in that it comprises automated transfer means to move the forks between the different working stations of the plant, and control means to command coordinated actuation of the different stations of the plant and of the transfer means.

* * * * *